US007802785B2

(12) United States Patent
Kobayashi et al.

(10) Patent No.: US 7,802,785 B2
(45) Date of Patent: Sep. 28, 2010

(54) APPARATUS FOR SEPARATING AND EXTRACTING SHEETS UTILIZING A VIBRATION AND AN AIR FLOW

(75) Inventors: Yuko Kobayashi, Kawasaki (JP); Kiminori Toya, Kawasaki (JP); Hideki Nukada, Yokohama (JP); Masaki Takahashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/393,264

(22) Filed: Feb. 26, 2009

(65) Prior Publication Data

US 2009/0218752 A1 Sep. 3, 2009

(30) Foreign Application Priority Data

Feb. 29, 2008 (JP) ..... 2008-051057

(51) Int. Cl.
*B65H 3/62* (2006.01)

(52) U.S. Cl. ..... 271/146

(58) Field of Classification Search ..... 271/146
See application file for complete search history.

(56) References Cited

U.S. PATENT DOCUMENTS 4,188,026 A * 2/1980 Nagai ..... 271/148
5,478,066 A 12/1995 Yoshida et al.
2007/0205551 A1 9/2007 Nukada et al.
2007/0273080 A1 11/2007 Toya et al.
2008/0223520 A1 9/2008 Toya et al.

FOREIGN PATENT DOCUMENTS

DE 19943029 A1 * 4/2000
JP 06-048602 2/1994
JP 06-247576 9/1994
JP 2000219334 A * 8/2000
JP 2007-145567 6/2007
JP 2007145567 A * 6/2007

* cited by examiner

*Primary Examiner*—Gene Crawford
*Assistant Examiner*—Gerald W McClain
(74) *Attorney, Agent, or Firm*—Turocy & Watson, LLP

(57) ABSTRACT

In an apparatus, a pile of sheets is mounted on a support base, and is brought into contact with a guide. A high-frequency vibration is applied to the sheets from a vibrating part which is pressed to the pile. A sheet on the uppermost surface of the pile is transferred by a feed roller. The guide has a guide end defining a guide entrance between the guide end and the feed roller, through which the sheets is passed. The guide end is arranged substantially in a virtual plane including a contact position at which the vibrating part is in contact with the uppermost surface of the pile, and substantially parallel with the sheets. A separation section for separating sheets from each other is arranged behind the entrance, and an air blow-off section for blowing air into the side of the pile is provided in the vicinity of the entrance.

7 Claims, 8 Drawing Sheets

APPARATUS FOR SEPARATING AND EXTRACTING SHEETS UTILIZING A VIBRATION AND AN AIR FLOW

CROSS-REFERENCE TO RELATED APPLICATIONS

This application is based upon and claims the benefit of priority from prior Japanese Patent Application No. 2008-051057, filed Feb. 29, 2008, the entire contents of which are incorporated herein by reference.

BACKGROUND OF THE INVENTION

1. Field of the Invention

The present invention relates to a separation/extraction apparatus for separating sheets of paper or paper-like medium from a pile of sheets of the medium in which sheets of paper or paper-like medium are stacked on a one-by-one basis, and extracting the separated sheet of paper or paper-like medium.

2. Description of the Related Art

In an apparatus for inspecting and processing sheets of paper (also called paper-like medium) such as a printer, copying machine, automated teller machine (ATM), banknote processing machine, mail processing machine, and the like, sheets of paper or paper-like medium such as printing paper, banknotes, copying paper, sealed letters, postcards, cards, securities, and the like are handled. However, it is necessary to extract a sheet of paper or paper-like medium one by one from a pile of sheets in which the sheets are stacked. Accordingly, the inspection/processing apparatus is provided with a separation/extraction apparatus for separating sheets of paper from a pile of sheets of the medium in which sheets of paper are stacked one on top of the other on a one-by-one basis, and extracting the separated sheets of paper or paper-like medium.

Heretofore, in a separation/extraction apparatus for separating sheets of paper (paper-like medium) from a pile of sheets of the medium in which sheets of paper are stacked one on top of the other, it is necessary to extract sheets of paper into the apparatus with good accuracy, and without causing any duplicate extraction. However, in the pile of sheets of the medium, the sheets of paper are in a state where the sheets of paper are in close contact with each other for a long time, and the sheets of paper adhere to each other in many cases. Thus, it is difficult to securely separate the sheets of paper from the pile of sheets of the medium one by one.

Thus, as disclosed in JP-A 2007-145567 (Kokai), a separation/extraction apparatus is proposed in which a vibrator is brought into contact with a top surface of the pile of sheets of the medium in a spot-like form to vibrate the sheets of paper or paper-like medium, thereby lowering the adhesion force between the sheets of paper in advance.

According to the separation/extraction apparatus disclosed in JP-A 2007-145567 (Kokai), it is possible to reduce the adhesion force between the sheets of paper or paper-like medium in the stacked state in advance, sufficiently suppress the frictional force between the uppermost sheets of paper and the sheets of paper stacked, extract only the uppermost sheets of paper one after another, and prevent duplicate extraction of the sheets of paper from occurring. However, when the stiffness of the sheets of paper is small (soft and feeble), the friction reducing effect by the ultrasonic vibration is liable to be reduced. Further, as for separation of an electrostatically charged sheets of paper stack, there is a problem that it is difficult to separate sheets of paper from the stack only by the ultrasonic vibration.

As described above, in the conventional separation/extraction apparatus, it is not possible to realize all-round handling for sheets of paper in various states, and development of a separation/extraction apparatus capable of giving an undoing effect to sheets of paper in all states is demanded.

BRIEF SUMMARY OF THE INVENTION

According to one aspect of the present invention, there is provided a separation/extraction apparatus comprising:

a support base configured to support a pile of sheets which are stacked, each sheet being a paper like medium;

a sensor which detects the uppermost surface of the pile of sheets;

a vibrating part having a contact end which is vibrated and is in contact with the uppermost surface at a first contact position, which apply ultrasonic vibration to the pile of sheets, the first contact position defining a first virtual plane which includes the first contact position and is substantially parallel with the pile of sheets;

a pressing mechanism configured to apply a pressing force to the vibrating part so as to press the vibrating part against the pile of sheets;

an extraction mechanism configured to extract a sheet or sheets of the uppermost surface from the pile of sheets in a transfer direction, and transferring the extracted the sheet or sheets, the extraction mechanism having an outermost circumference part which is contact with the sheet or sheets at a second contact position, and the second contact position defining a second virtual plane which includes the second contact position and is substantially parallel with the pile of sheets;

a guide having a surface which is brought into contact with the pile of sheets to straighten the sheets, wherein the guide further has a guide end defining a guide entrance between the guide end and the extraction mechanism, the sheets being guided to the guide entrance from the pile of sheets and extracted through the guide entrance, the guide end being substantially arranged in the first virtual plane or between the first virtual plane and the second virtual plane;

a separation part configured to separate the sheets extracted from the pile of sheets from each other, the separation part forming a transfer path of the sheets passing through the guide entrance; and an air blow-off part configured to blow air into the side surface of the pile of sheets.

DETAILED DESCRIPTION OF THE INVENTION

A separation/extraction apparatus of sheets of paper-like medium such as paper according to a first embodiment of the present invention will be described with referring to the accompanying drawings.

Figure 1:
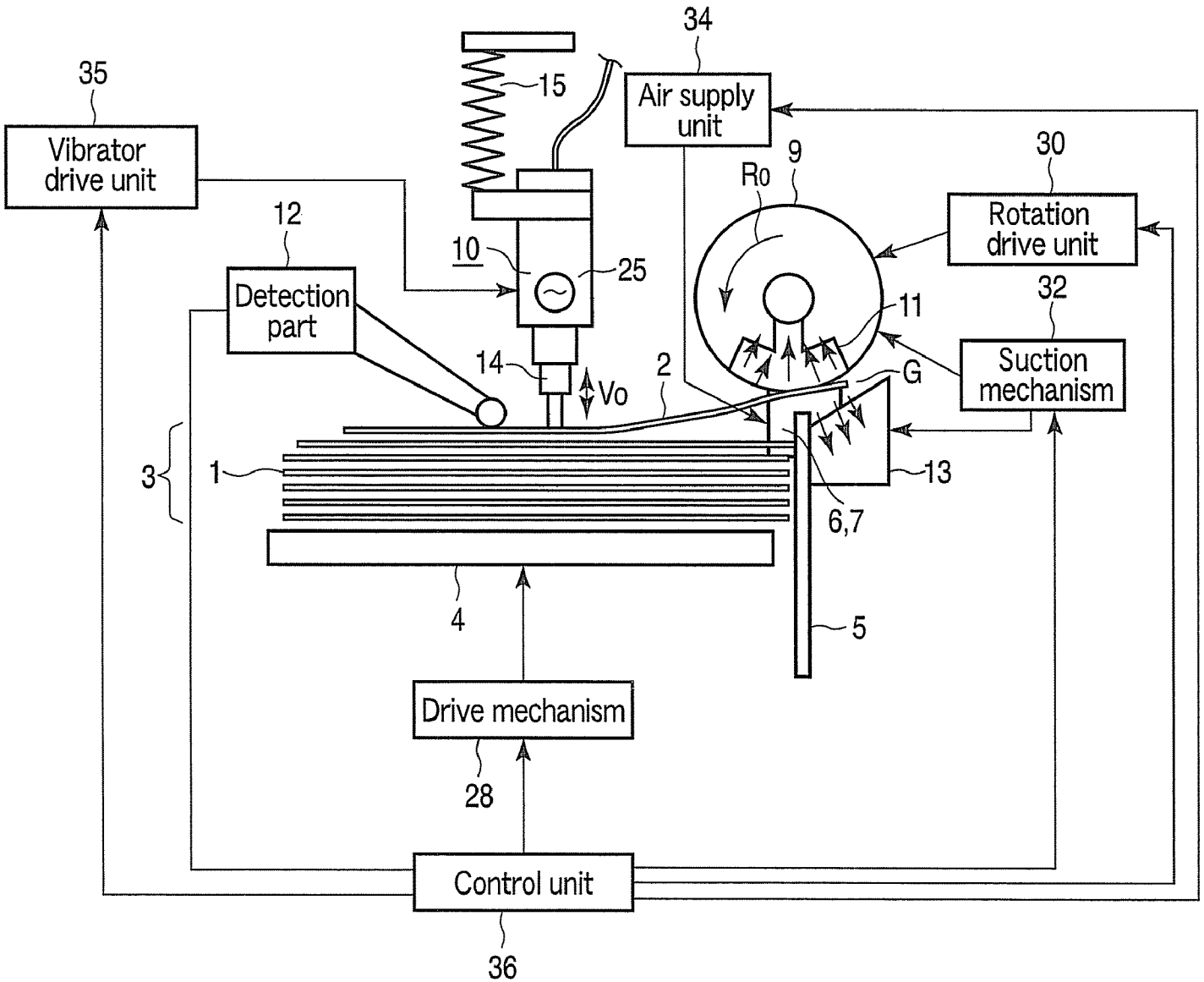
FIG. 1 is a schematic view showing the configuration of a separation/extraction apparatus according to a first embodiment.
Figure 2:
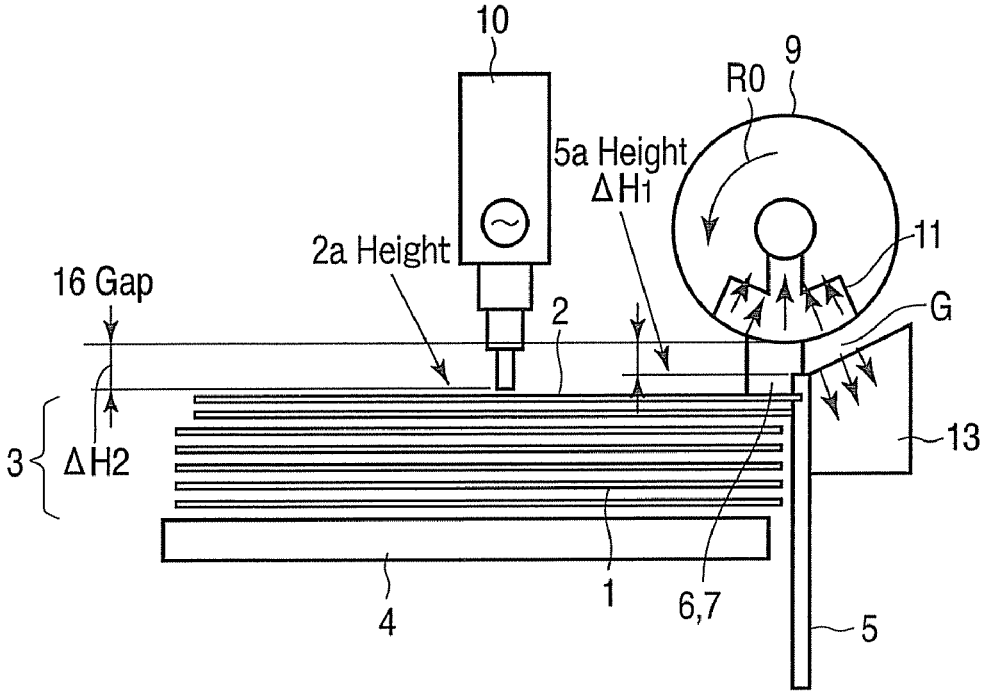
FIG. 2 is a schematic view showing a separation/extraction apparatus for explaining the arrangement of each section of the separation/extraction apparatus shown in FIG. 1.

FIG. 1 shows a separation/extraction apparatus according to a first embodiment of the present invention, and FIG. 2 shows an arrangement relationship between each section shown in FIG. 1. The separation/extraction apparatus shown in FIG. 1 is provided with a support base 4 on which a pile of sheets of the medium 3 formed by stacking sheets of paper or paper-like medium 1 one on top of the other is placed. The support base 4 supports the pile of sheets of the medium 3, and is driven to be elevated or lowered by a drive mechanism 28. Accordingly, a position of the uppermost surface of the pile of sheets of the medium 3 is adjusted by the drive mechanism 28. The pile of sheets of the medium is configured by stacking sheets of paper normally having a rectangular (oblong) shape one on top of the other, and hence it is formed into a cube (cuboid) as long as the sheets of paper are arranged by putting the positions of the sheets of paper in order. Accordingly, the pile of sheets of the medium 3 has top and bottom surfaces, and front and back side surfaces. Further, the pile of sheets of the medium includes right and left side surfaces. Here, the bottom surface corresponds to a surface in contact with the support base 4, and the top surface corresponds to a surface of sheets of paper of the uppermost surface of the pile of sheets of the medium opposed to the bottom surface. Further, the front side surface is faced to the front which is defined as a transfer direction in which the sheets of paper are extracted, and the back side surface is opposed to the front side surface, and corresponds to a rear surface opposite to the transfer direction. As will be described later, when the support base 4 is inclined, the pile of sheets of the medium is not formed into a cuboid, and is formed into a shape obtained by inclining the surfaces of a cube in accordance with the inclination of the support base 4.

On the pile of sheets of the medium 3, a detection sensor 12 having a contactor, which detects a height of the pile of sheets of the medium 3, i.e., a position of the sheets of paper 2 of the uppermost surface is arranged to be in contact with the sheets of paper 2, the detection sensor 12 being, for example, a rotary lever detection sensor provided with a roller at a distal end thereof. The roller of the contact type sensor is caused to be in contact with the sheets of paper 2 of the uppermost surface of the pile of sheets of the medium 3, the angle of the rotary lever is detected, and the height of the top surface of the pile of sheets of the medium 3 is detected. The detection sensor 12 is not limited to the contact type, and may be replaced with a non-contact sensor such as an optical displacement gage.

Further, a vibrator unit 10 for applying ultrasonic vibration to the pile of sheets of the medium 3 is arranged in such a manner that a distal end (contact end) of the vibrator unit 10 is in contact with the pile of sheets of the medium 3. The vibrator unit 10 is mechanically connected to a pressing spring 15 for pressing the vibrator unit 10 against the pile of sheets of the medium 3 at a constant pressure, and the pressing force applied from the vibrator unit 10 to the pile of sheets of the medium 3 is maintained constant by the pressing spring 15. In the state where the pressing force is maintained constant, ultrasonic vibration V0 is applied from the vibrator unit 10 to the pile of sheets of the medium-3 in a direction substantially perpendicular to the surface of the pile of sheets of the medium 3.

Here, it is desirable that the contactor (roller) of the detection sensor 12 be in contact with the pile of sheets of the medium 3 at a position close to a contact position (vibration application position) on the pile of sheets of the medium 3 at which the vibrator 14 of the vibrator unit 10 is brought into contact with the pile of sheets of the medium 3. Alternatively, it is desirable that the contactor (roller) of the detection sensor 12 be in contact with the pile of sheets of the medium 3 on the opposite side of the contact position of the vibrator 14 to the extraction direction of the sheets of paper 2, the contact position being used as a reference. As will be described later, the pile of sheets of the medium 3 is blown up by the side surface air 6, 7, and hence in order to accurately detect the height of the sheets of paper 2 of the uppermost surface to be used as a reference, it is desirable that the contact point of the detection part 12 be arranged at the above-mentioned position.

Here, as shown in FIG. 1, the vibrator unit 10 has a structure in which the vibrator 25 is connected to an ultrasonic horn 14. The vibrator 25 is called a bolted vibrator, has a structure in which an electrode is extended from the inside of a piezo-ceramic part serving as a piezoelectric element to the outside, and the piezo-ceramic part is bolted between a pair of columnar blocks by a bolt, and the ultrasonic horn 14 is screwed on the blocks, thereby fixing the ultrasonic horn 14 to the vibrator 25.

In this vibrator 25, when the disk-like piezo-ceramic part is ultrasonically vibrated in accordance with a drive voltage applied to the electrode, the entire vibrator unit 10 is vibrated, and the vibration is transmitted to a vibrating surface of the columnar block. The amplitude of the piezo-ceramic part is relatively small, and there is the possibility of the piezo-ceramic part being unable to apply vibration capable of sufficiently undoing the sheets of paper or paper-like medium 1 and 2 to the pile of sheets of the medium 3 even when the ultrasonic vibration V0 is extracted from the vibrating surface of the columnar block, and is applied to the surface of the pile of sheets of the medium 3. Thus, in order to amplify the ultrasonic vibration V0, the vibrator 25 is mechanically connected to the ultrasonic horn 14. The vibrator 25 is vibrated by being driven by a drive signal from a vibrator drive unit 35.

The vibrator unit 10 provided with the ultrasonic horn 14 described above is vibrated at the distal end section in a direction V0 substantially perpendicular to the surface of the pile of sheets of the medium 3. In the vibrator unit 10, when the ultrasonic horn 14 is pressed against the top section of the pile of sheets of the medium 3, both the friction between the distal end of the ultrasonic horn 14 and the sheets of paper 2 of the uppermost surface, and the friction between the uppermost surface sheets of paper 2 and the sheets of paper 1 stacked thereunder become sufficiently low. In this state, by transferring away the uppermost surface sheets of paper or paper-like medium, it is possible to realize separation with less duplicate extraction.

Incidentally, when it is possible to sufficiently undo the sheets of paper 1, 2 by the ultrasonic vibration V0 extracted from the vibrating surface of the columnar block, the ultrasonic horn 14 may not necessarily be provided. Further, the effective ultrasonic frequency is set at a frequency in the range of about 18 kHz to 28 kHz as a low frequency of an audible frequency range or higher.

Figure 4:
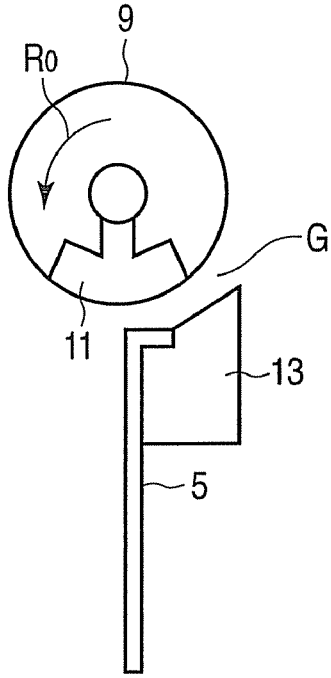
FIG. 4 is a schematic view showing a modification example of the front side surface guide of the separation/extraction apparatus shown in FIG. 3.
Figure 5:
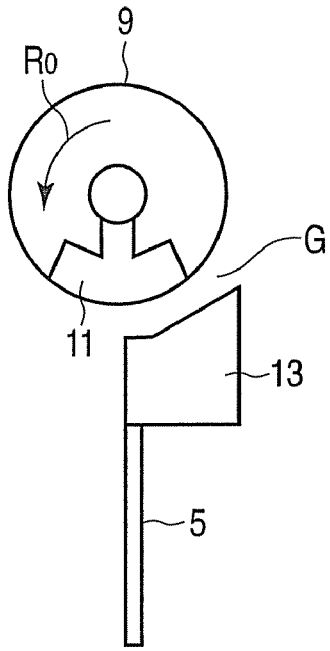
FIG. 5 is a schematic view showing, in an enlarging manner, a separation part according to a modification of the separation/extraction apparatus shown in FIG. 1, in which the separation part is provided in place of the front side surface guide of the separation/extraction apparatus shown in FIG. 1, the separation part being provided with sheets entry section.

The separation/extraction apparatus shown in FIG. 1 is provided with a front side surface guide 5 for putting the positions of the sheets of paper 1 in order. The front side surface guide 5 is not limited to the form shown in FIG. 3, and may be formed as shown in FIG. 4 or 5. The front side surface guide 5 is brought into contact with the front side surface of the pile of sheets of the medium 3, thereby putting the positions of the sheets of paper 2 in order. Further, a separation part 13 is provided in contact with the front side surface guide 5 in the extraction direction of the front side surface guide 5. The separation part 13 has an inclined surface formed in the direction in which the sheets of paper 2 is extracted from the top surface of the pile of sheets of the medium 3. A feed roller 9 serving as an extraction mechanism for extracting sheets of paper 2 of the uppermost surface from the pile of sheets of the medium 3 is arranged above the upper end of the front side surface guide 5. Accordingly, a guide opening is defined between the feed roller 9 and the guide end of the front side surface guide 5. The feed roller 9 is also arranged to form a gap G between itself and the inclined surface of the separation part 13, thereby defining a transfer path communicating with the guide opening. The feed roller 9 is driven to be rotated by a rotation drive mechanism 30, and is connected to a suction mechanism 32 to be given a negative pressure therein. A sheets of paper 1 undone and extracted by the ultrasonic vibration of the vibrator unit 10 is sucked by the feed roller 9 given the negative pressure, directed to the inclined surface of the separation part 13, and is transferred along the inclined surface of the separation part 13 with the rotation of the feed roller 9 indicated by an arrow R0.

The feed roller 9 is formed into a cylindrical shape, and is provided with a suction part 11 including a negative-pressure chamber communicating with the suction mechanism 32. A flexible sheet such as a rubber sheet having a suction opening is stuck on the outer circumference or a part of the circumference of the feed roller 9. The suction mechanism 32 is provided with a first electromagnetic valve (not shown) for the suction part, and a negative pressure is supplied to the negative pressure chamber of the suction part 11 in accordance with opening/closing of the first electromagnetic valve. After the rotation of the feed roller 9 is settled, the first valve is opened in response to a detection signal from the detection sensor 12, and a vacuum (negative pressure) is supplied to the negative pressure chamber from the suction mechanism 32. Accordingly, when the flexible sheet is opposed to the sheets of paper 2, the tip end of the sheets of paper 2 is sucked by the suction opening of the suction part 11, the sheets of paper 2 is pulled up with the rotation of the feed roller 9, and the tip end of the sheets of paper 2 is guided into the gap G.

Incidentally, in the separation/extraction apparatus shown in FIG. 1, the extraction mechanism 32 using vacuum suction/attraction is adopted as a mechanism for extracting the sheets of paper 1 while preventing duplicate extraction from occurring. However, a friction separation mechanism utilizing frictional force may be used as the extraction mechanism in place of the extraction mechanism 32 using the vacuum suction/attraction.

The separation part 13 includes a cavity (not shown) communicating with the suction mechanism 32, and the cavity communicates with a plurality of opening sections opened in the inclined surface along which the sheets of paper or paper-like medium 2 is transferred through a channel (not shown). The suction mechanism 32 is provided with a second electromagnetic valve (not shown) for the separation part, and a negative pressure is supplied to the cavity of the separation part 13 in accordance with opening/closing of the second electromagnetic valve. In response to a detection signal from the detection sensor 12, the second electromagnetic valve is opened, a negative pressure is supplied to the cavity of the separation part 13 from the suction mechanism 32, suction force is produced at the opening sections of the inclined surface, and the sheets of paper 2 is sucked by the opening sections on the inclined surface. The suction force at the suction part 11, and the suction force at the opening sections on the inclined surface are appropriately selected and are matched with each other, whereby the sheets of paper is transferred along the inclined surface with the rotation of the feed roller 9.

In the separation/extraction apparatus shown in FIG. 1, the vibrator unit 10 is brought into point contact with the sheets of paper 2 of the uppermost surface of the pile of sheets of the medium 3, and vibration is applied thereto, whereby it is possible to make the adhesion force between the sheets of paper 1 and 2 small in advance. That is, the adhesion force between the sheets of paper 1 and 2 in the form of a stack is reduced in advance, the frictional force between the sheets of paper 2 and the sheets of paper stacked thereunder is sufficiently reduced, and then the sheets of paper 2 are extracted, whereby it is possible to prevent duplicate extraction of the sheets of paper 1 and 2 from occurring. It is experimentally confirmed that this undoing system utilizing the ultrasonic vibration is highly effective for brand-new banknotes (so-called unbending sheets of paper 1, 2) and the like having high stiffness. Further, it is also confirmed that with respect to even a stack constituted of sheets of paper 1, 2 having different friction coefficients, stable separation/extraction can be achieved by reducing the friction between sheets of paper 1, 2, and by alleviating the difference in the initial friction coefficient. However, with respect to sheets of paper 1, 2 (so-called soft sheets of paper or paper-like medium 1, 2) having small stiffness, it is experimentally confirmed that the friction reduction effect by the ultrasonic vibration tends to be reduced. Thus, in the separation/extraction apparatus shown in FIG. 1, air blow-off parts 6 and 7 are provided on both sides in front of the pile of sheets of the medium 3. The air blow-off part 6, 7 communicates with an air supply unit 34, and air supplied from the air supply unit 34 is supplied to the sheets of paper 1 and 2 constituting the pile of sheets of the medium 3 from the air blow-off parts 6 and 7. Accordingly, with respect to even sheets of paper 1 and 2 (so-called soft sheets of paper or paper-like medium 1, 2) having small stiffness, it is possible to effectively undo the sheets of paper or paper-like medium.

Incidentally, sheets of paper largely differ in stiffness (Young's modulus) depending on the material, size, thickness, and ambient environment (particularly, humidity). In general, it is said that the Young's modulus of sheets of paper including postcards is in the range of about 1 to 20 [GPa]. However, in ordinary copying paper or the like, the Young's modulus is in the range of about 1 to 3 GPa. When the Young's modulus is high, the sheets of paper is called an unbending sheets of paper or paper-like medium, and when the Young's modulus is low, the sheets of paper is called a soft sheets of paper or paper-like medium. In the banknote or the like, the stiffness largely differs depending on the usage state, i.e., a folded state, crumpled state, and brand-new state. A brand-new banknote is said to be high in Young's modulus (unbending), and a crumpled banknote is said to be soft. Incidentally, in this description, it is considered that sheets of paper having the Young's modulus equal to about 1 GPa or less are soft sheets of paper or paper-like medium.

When only the undoing system in which air from the air supply unit 34 is blown against the side surfaces of the sheets of paper 1, 2 is adopted, it is desirable that air be blown onto the vicinity of the edge part of the pile of sheets of the medium close to the extraction direction on the side surface perpendicular to the extraction direction from one part or both parts. On the edge part of the pile of sheets of the medium, air can easily enter the pile of sheets of the medium with less binding of the sheets of paper to the pile of sheets of the medium, and it is possible to stably perform extraction by undoing the sheets of paper at a part close to the extraction direction. By simply blowing air to the pile of sheets of the medium 3, air cannot be blown into spaces between sheets of paper 1, 2. Particularly, when the sheets of paper 1, 2 are undone by utilizing air, the air undoing is not good at undoing of sheets of paper of brand-new banknotes, and is liable to be affected by the friction between the sheets of paper or paper-like medium. In the separation/extraction apparatus shown in FIG. 1, undoing utilizing the ultrasonic vibration is adopted in addition to the undoing utilizing air, it becomes possible to stably separate and extract the sheets of paper irrespective of the state of friction between the sheets of paper 1, 2 or the state of stiffness of the sheets of paper or paper-like medium.

Incidentally, undoing utilizing ultrasonic vibration and undoing utilizing air may be simultaneously adopted and used. Further, the undoing system may be selected in accordance with the state of the paper stack. For example, after the sheets of paper 1, 2 are undone by being subjected to undoing utilizing ultrasonic vibration and undoing utilizing air, only one of the undoing utilizing ultrasonic vibration and undoing utilizing air may be performed. When the undoing utilizing ultrasonic vibration is not performed, the vibrator unit 10 is retracted by means of a moving mechanism. Further, a sensor for detecting the stacked state of the pile of sheets of the medium may be separately provided, and the state (undone state) of the stack of the pile of sheets of the medium may be detected.

It is desirable that the air blow-off parts 6 and 7 be provided to be opposed to each other on one part or both parts of the side surface of the pile of sheets of the medium 3 perpendicular to the extraction direction, and air be blown upon the vicinity of the tip end section of the pile of sheets of the medium 3, i.e., the tip end sections of the sheets of paper 1, 2 extracted by the feed roller 9. As for the tip end section of the pile of sheets of the medium 3, binding of the sheets of paper 1, 2 is small as compared with the central part of the pile of sheets of the medium 3, air can easily enter the inside of the pile of sheets of the medium 3, and hence it is possible to undo the sheets of paper 1, 2 at the time of extraction of the sheets of paper 1, 2.

Figure 6:
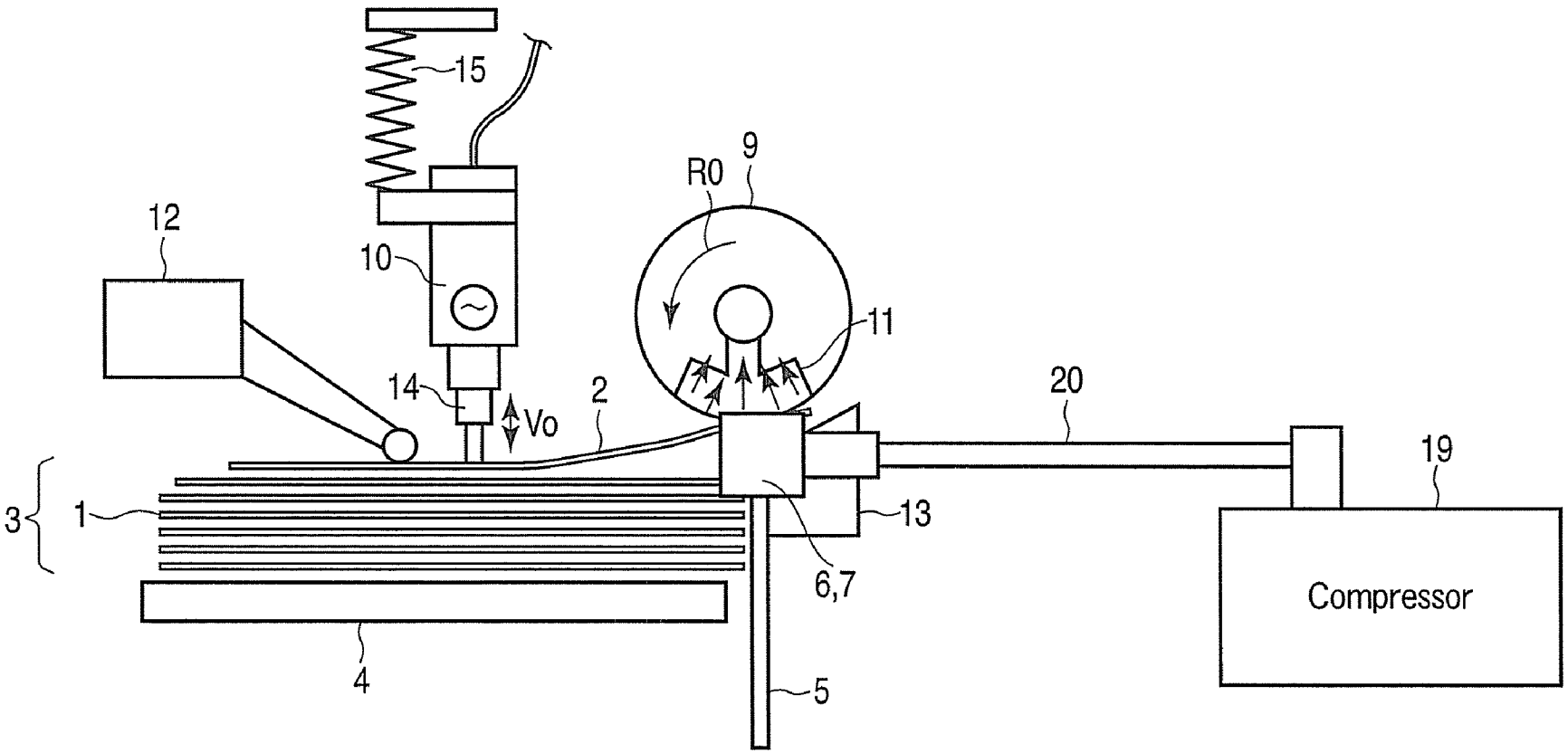
FIG. 6 is a schematic view showing the configuration of an air supply unit in the separation/extraction apparatus shown in FIG. 1.

The air supply unit 34 is configured, specifically, as shown in FIG. 6. That is, the air supply unit 34 is provided with a compressor 19, and when an electromagnetic valve (not shown) is opened, compressed air from the compressor 19 is supplied to the air blow-off parts 6 and 7 through, for example, a hose or a pipe. Thus, the compressed air is blown upon the front end section of the sheets of paper 1, 2 on the guide side from the air blow-off parts 6 and 7.

Ionized air is spouted out from the air blow-off parts 6 and 7, and the electric charge of the electrostatically charged sheets of paper 1, 2 can be removed. Usually, when ionized air is supplied to a charged stack of sheets of paper 1, 2, only the electric charge on the surface of the paper stack is removed, and the electric charges between the sheets of paper 1, 2 cannot be removed. Ionized air is blown into small gaps between the sheets of paper 1, 2 formed by slightly separating the sheets of paper 1, 2 from each other by the ultrasonic vibration, whereby the ionized air spreads over the gaps between the sheets of paper 1, 2, and secure removal of the electric charges is enabled. Accordingly, it becomes possible to perform stable separation/extraction of the sheets of paper 2 even in an environment in which humidity is low, and electrification is easily caused.

Figure 7:
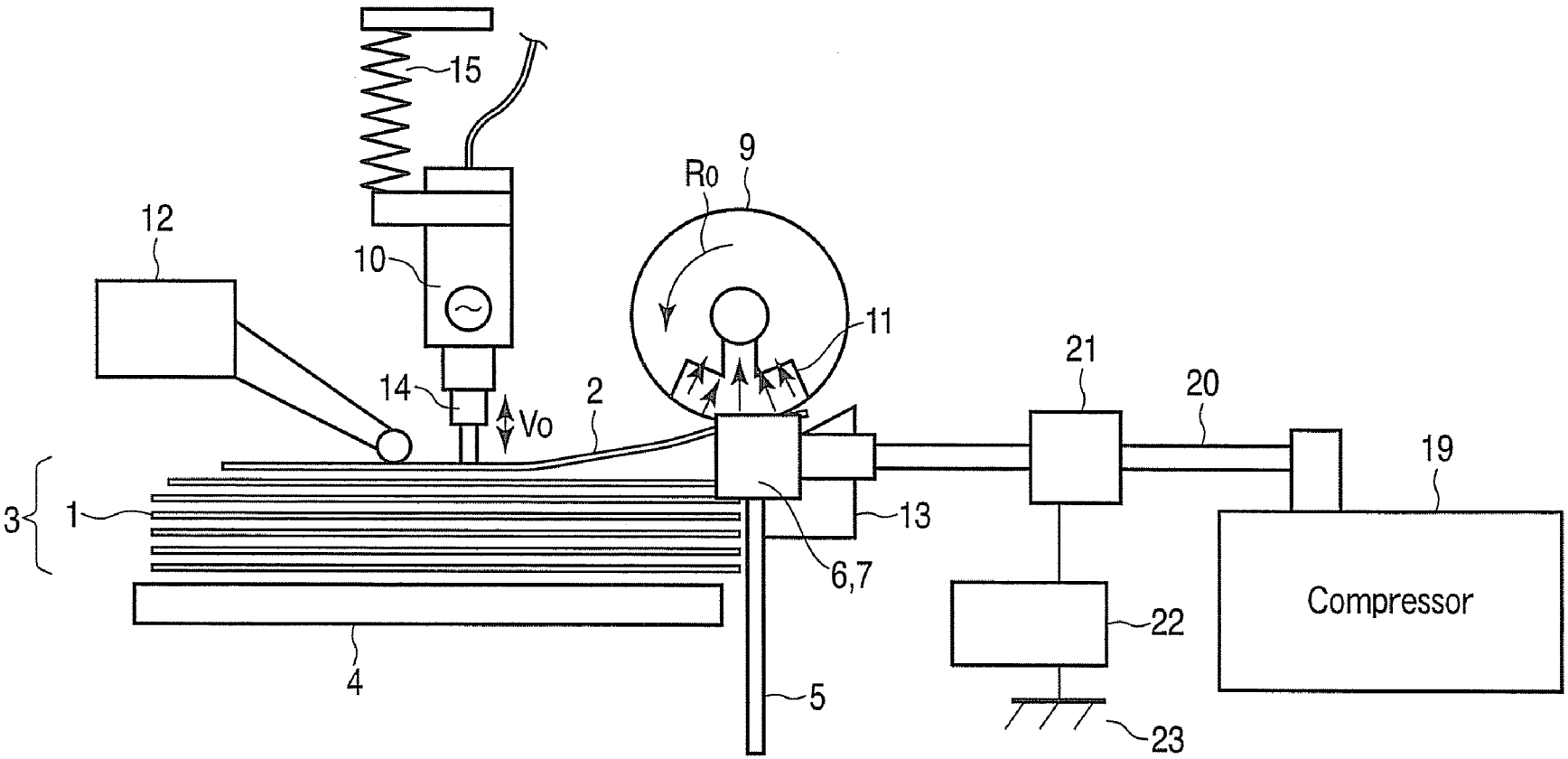
FIG. 7 is a schematic view showing a modification of the air supply unit in the separation/extraction apparatus shown in FIG. 6.

The air supply unit 34 for supplying ionized air is, specifically, provided with a static eliminator 21 at an airflow supply path part 20 thereof as shown in FIG. 7, and the static eliminator 21 is connected to a high-voltage power source 22 connected to the ground 23. The static eliminator 21 is provided with an electrode needle, and a positive high voltage and a negative high voltage are alternately applied to the electrode needle from the high-voltage power source 22. Accordingly, a corona discharge is caused in the static eliminator 21 concomitantly with the application of the high voltage, the compressed air supplied from the compressor 19 is ionized, and the ionized air is blown upon the front end section of the sheets of paper or paper-like medium 1, 2 on the guide side from the air blow-off parts 6 and 7.

Incidentally, a metallic body lowers the static eliminating capability, and hence it is desirable that the housing or the like of the air blow-off parts 6 and 7 be not made of metal. Further, the high-voltage power source 22 needs to be connected to the ground electrode, or to be connected to the ground without fail. If the power source 22 is not grounded, there is the possibility of electrification occurring inside the static eliminator 21, a discharge occurring from the static eliminator 21, and the static eliminator itself being damaged.

Figure 8:
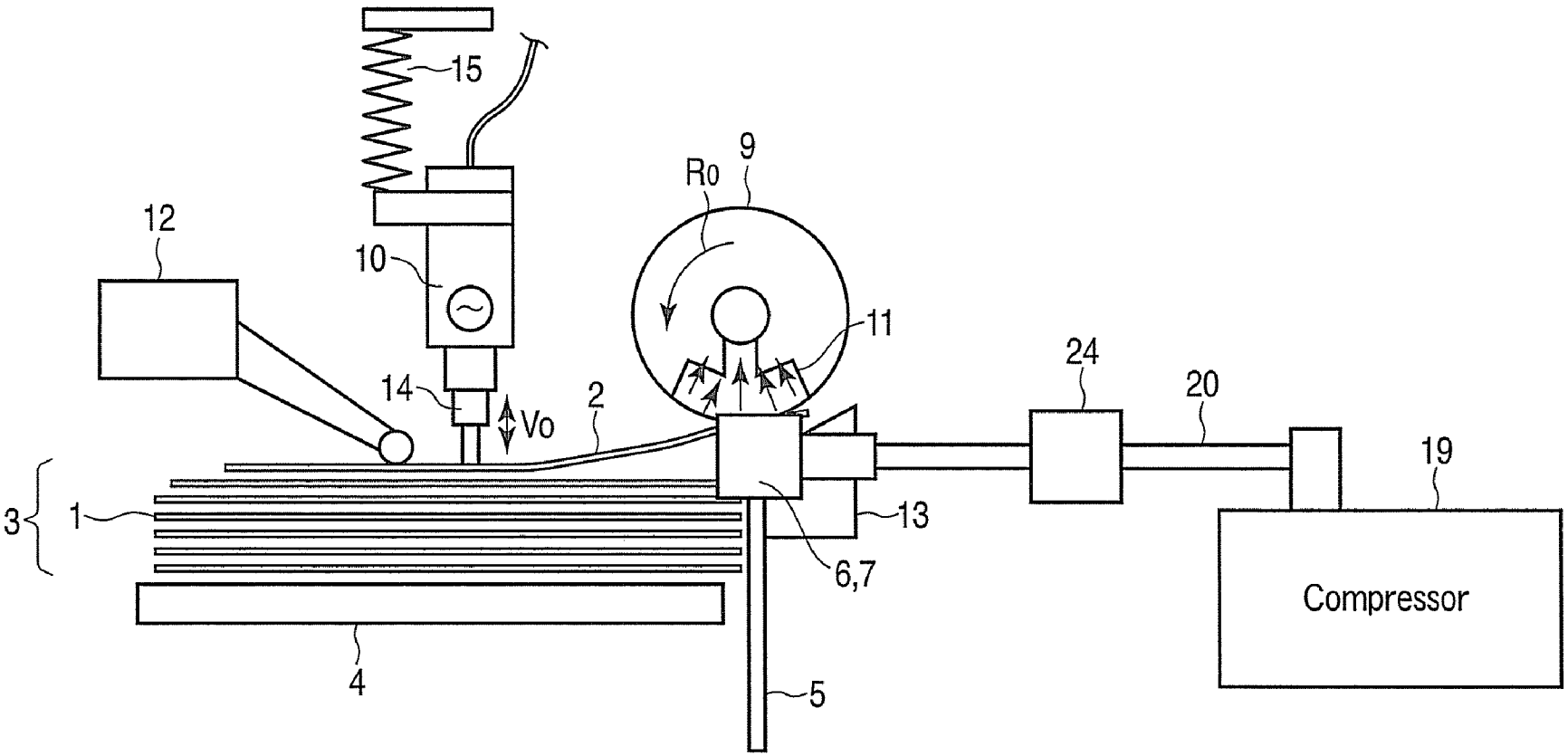
FIG. 8 is a schematic view showing another modification of the air supply unit in the separation/extraction apparatus shown in FIG. 6.

In general, when relative humidity in an atmosphere in which sheets of paper 1, 2 are placed becomes lower than 35%, even paper (sheets of paper or paper-like medium) which is hard to be electrified becomes easy to be electrified. However, by raising relative humidity, electrification can be prevented (at 65% RH or higher). Accordingly, it is desirable that the humidity of air spouted out from the air blow-off parts 6 and 7 be made higher. Thus, as shown in FIG. 8, in place of the static eliminator 21 or in addition to the static eliminator 21, a humidifier 24 may be provided in the airflow supply path part 20. The method of humidifying compressed air using a humidifier 24 includes the method of a steam type (water is boiled), the method of an evaporation type (water is evaporated), the method of an ultrasonic type (water is formed into fine grains, and spouted out in that form), and the like, and each of them can be used. The compressed air is made to contain moisture by the humidifier 24, the humidity in the air is raised, and the humidified air is blown over the front end section of the sheets of paper 1, 2 on the guide side. Accordingly, the sheets of paper 1, 2 are hard to be electrified so that the sheets of paper 1, 2 become easy to be separated from each other.

In the separation/extraction apparatus shown in FIG. 1, a gap G having a distance $\Delta H1$ between the upper end of the front side surface guide 5 and the outer circumference of the feed roller 9 is formed as shown in FIG. 2, and a distance $\Delta H2$ is given between the distal end of the vibrator unit 10 at which the body 10 is in contact with the sheets of paper 2, i.e., the uppermost surface of the pile of sheets of the medium 3, and a virtual plane which is parallel with this sheets of paper 2 and is in contact with the outer circumference of the feed roller 9. Here, the distance ΔH2 is determined in such a manner that ΔH2 is equal to or larger than ΔH1. (ΔH2≧ΔH1) This relationship implies that the sheets of paper 2 of the uppermost surface of the pile of sheets of the medium 3 is arranged at a position of a height substantially equal to the upper end of the front side surface guide 5 or a position lower than the upper end of the front side surface guide 5, the tip end of the sheets of paper 2 of the uppermost surface is lifted by the suction part 11 of the feed roller 9, and the air from the air blow-off parts 6 and 7 by a distance of about ΔH2 to be attracted to the suction part 11, and the sheets of paper 2 of the uppermost surface is guided into the gap G having the distance ΔH1.

The arrangement shown in FIG. 2 is based on the following reasons.

In the undoing system utilizing the ultrasonic vibration, there is the possibility of the friction between sheets of paper 1, 2 becoming very small, and the notes being gradually moved by small external force (gravity, or force applied to the notes during transfer) in the extraction direction from the upper notes. When a large number of sheets of paper 1, 2 are positioned higher than the upper end of the front side surface guide 5 during extraction of the sheets of paper 1, 2, there is the possibility of the large number of sheets of paper 1, 2 entering the gap between the feed roller 9 and the separation part 13, and hindering the function of the separation part 13, of separating the sheets of paper 1, 2 into single pieces. In the separation system realized by attraction utilizing the negative pressure, there is the possibility of the separation capability being largely lowered by the entering of such a stack of sheets of paper 1, 2.

As described above, in the separation/extraction apparatus shown in FIG. 1, the sheets of paper undone by largely reducing friction between the sheets of paper 1, 2 by applying vibration to the top surface of the pile of sheets of the medium 3, i.e., by a so-called vacuum extraction separation system are fed piece by piece. In feeding the sheets of paper or paper-like medium, the support base 4 is controlled in such a manner that the height of the top surface of the pile of sheets of the medium 3 is within a certain height range at all times, or the pressing force between the contact section of the vibrating unit 10 and the sheets of paper 1, 2 is within a certain range.

In consideration of the above matters, it is desirable that the height of the sheets of paper 2 before the vibrator 14 is brought into contact with the sheets of paper 2 be equal to or less than the height of the distal end section of the front side surface guide 5 (ΔH1≦ΔH2). At the same time, it is desirable that even during extraction or transfer, the support base 4 be controlled in such a manner that the height of the sheets of paper 2 of the uppermost surface is equal to or less than the height of the upper end section of the front side surface guide 5 in the extraction direction (ΔH1≦ΔH2). By such setting, sheets of paper 1 of a part of the pile of sheets of the medium 3 is prevented from directly entering the gap 17 between the feed roller 9 and the separation part 13. In the result of the actual experiment too, it is confirmed that it is possible to stably extract the sheets of paper when the height of the sheets of paper 2 of the uppermost surface is, during extraction or transfer, equal to or less than the height of the upper end section of the front side surface guide 5 in the extraction direction (ΔH1≦ΔH2). However, it is confirmed that if the height of the sheets of paper 2 is set higher than the equivalent position by 1 mm, the probability of the defective extraction occurring becomes high.

Incidentally, even when the gap 16 between the lowest section position of the feed roller 9 and the uppermost surface sheets of paper 2 becomes larger, the uppermost surface sheets of paper 2 is attracted by the suction force of the feed roller 9, and the blowing up of the side surface air 6, 7 (air on the near side is not shown), and is transferred. Incidentally, the side surface air 6, 7 is not limited to the both sides, and may be provided only on one side.

As shown in FIG. 1, a position signal of the uppermost surface position of the pile of sheets of the medium 3 detected by the sensor 12 as shown in FIG. 2 is supplied to a control unit 36, then is compared with a reference position in the control unit 36, and a difference signal is supplied to the drive mechanism 28. Accordingly, the support base 4 is controlled by the drive mechanism 28, and the uppermost surface position of the pile of sheets of the medium 3 is maintained at a constant position. Further, the rotation drive unit 30 is operated in accordance with a rotation instruction from the control unit 36, and the feed roller 9 is rotated at a constant rotational speed by a rotation drive signal from the rotation drive unit 30. Likewise, the air supply unit 34 is operated in accordance with an air supply instruction from the control unit 36, air is supplied to the air blow section from the air supply unit 34 to be spouted out toward the pile of sheets of the medium 3. Further, a first and second suction instruction signals are supplied to the suction mechanism 32 from the control unit 36 on the basis of the detection signal from the detection sensor 12, the first and second valves are opened, and the electromagnetic valve and a suction motor are stopped by an extraction operation end signal. Accordingly, until the motor is stopped, suction/attraction occurs at the suction part 11 and the separation part 13 by the first and second suction start instructions.

In the separation/extraction apparatus shown in FIG. 1, operations are performed under the control of the control unit 36 in the following manner. First, a rotation start signal is supplied to the rotation drive unit 30 from the control unit 36, and rotation of the feed roller 9 is started. At the rotation start time, the first electromagnetic valve of the suction mechanism 32 is closed, and the suction mechanism 32 is kept in the non-suction state. When the control unit 36 supplies an operation start signal to the drive mechanism 28, the drive mechanism 28 operates to raise the support base 4 on which the pile of sheets of the medium 3 is placed, and the pile of sheets of the medium 3 is elevated. When it is confirmed by the detection of the sensor 12 that the height of the sheets of paper 2 reaches a predetermined height, the control unit 36 controls the drive unit 28 to maintain the uppermost surface position of the pile of sheets of the medium 3 as it is. Further, when the height of the pile of sheets of the medium 3 is maintained at the optimum position (predetermined height), the control unit instructs the vibrator drive unit 35 to start vibration, and the vibrator drive unit 35 supplies a drive signal to the vibrator 25 to start vibration. Thus, ultrasonic vibration is applied to the pile of sheets of the medium 3, thereby undoing the sheets of paper 1, and making the sheets of paper 1 transferable. Further, in a state where the suction mechanism 32 is operated by an instruction from the control unit 36, and is maintained in a suction-enabled state, a first instruction is supplied to the first electromagnetic valve of the suction mechanism 32 from the control unit 36 on the basis of a detection signal from the detection sensor 12, the first electromagnetic valve is opened, and the tip end of the sheets of paper 2 is sucked when the suction part 11 of the feed roller 9 is opposed to the separation part 13. At this time, the tip end section of the sheets of paper 2 is lifted by the suction force produced between the feed roller 9 and the sheets of paper 2 of the uppermost surface of the pile of sheets of the medium 3, and the air supplied from the side surface air 6, 7, then is sucked by and attracted to the suction part 11 of the feed roller 9, the sheets of paper 2 is extracted by the frictional force of the rubber sheet on the surface of the suction part 11, and is then taken into sheets of paper processing apparatus (not shown) through the separation part 13 for preventing duplicate extraction. The feed roller may feed a sheet of paper per rotation, or may feed a plurality of paper sheets per rotation. Further, simultaneously with the supply of the first instruction, the second electromagnetic valve is opened by a second instruction, and suction force for sucking the sheets of paper 1 is produced at the separation part 13. Accordingly, while the sheets of paper 2 is fed, the succeeding sheets of paper 1 which is liable to enter the gap G following the preceding sheets of paper 2 is prevented from entering the gap G.

Concomitant with successive transfer operations of the sheets of paper 1 and 2, the sensor 12 detects the height of the pile of sheets of the medium 3, the support base 4 is raised by the drive mechanism 28 so that the height of the sheets of paper 2 can be maintained at a predetermined height, and the pile of sheets of the medium 3 is maintained at the predetermined height.

In the separation/extraction apparatus shown in FIG. 1, the sheets of paper 1 are stacked in the direction of gravity. However, the stacking of the sheets of paper 1 is not limited to the case where the sheets of paper 1 and 2 are stacked in the gravity direction, and the sheets of paper 1 and 2 may be arranged and stacked in column on the support base 4 to be in close contact with each other so that the sheets of paper 1 and 2 can be stacked one on top of the other in the direction perpendicular to the gravity. In such a lamination arrangement, the transfer direction is opposite to the gravity direction in the arrangement of FIG. 1 so that the front side surface guide 5 can be arranged in the upper part, and the right side in the drawing of FIG. 1 is defined as the upper part. In this description, as for the pile of sheets of the medium 3, the sheets of paper of the uppermost surface is, not only when the direction in which the sheets of paper are stacked on the support base is the direction against the gravity, but also when the direction is substantially horizontal, defined as the sheets of paper positioned farthest from the support base while the direction in which the sheets of paper are stacked on the support base is used as a point of reference. Accordingly, in a pile of sheets of the medium in which sheets of paper are arranged and stacked in column to be in close contact with each other, sheets of paper which is the object of extraction, and is exposed at the outermost part corresponds to the sheets of paper of the uppermost surface.

Figure 3:
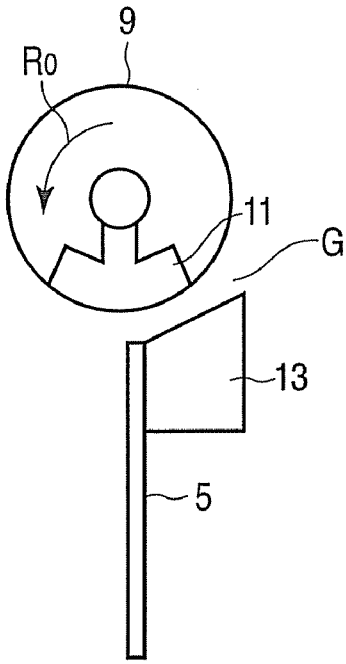
FIG. 3 is a schematic view showing a front side surface guide of the separation/extraction apparatus shown in FIG. 1 in an enlarging manner.

The front side surface guide 5 shown in FIG. 1 is arranged to be connected to the inclined surface of the separation part 13 as shown in FIG. 3, and the end face of the front side surface guide 5 is formed substantially perpendicular (substantially perpendicular along the transfer path) to the contact surface of the front side surface guide 5 to be brought into contact with the sheets of paper 1. However, the end section of the front side surface guide 5 may be bent into an L-shape to be buried in the inclined surface of the separation part 13 as shown in FIG. 4. Further, as shown in FIG. 5, the separation part 13 may be provided on the front side surface guide 5, and the part of the inclined surface of the separation part 13 on the entry side of the sheets of paper 1 may be provided with an entry end formed perpendicular to the contact surface of the front side surface guide 5 to be brought into contact with the sheets of paper 1. Although this entry end is separate from the guide 5, the entry end is called a guide end substantially functioning as a guide. By making the entrance section through which the sheets of paper enters the separation part have a right-angled shape as described above, it is possible to prevent sheets of paper succeeding the sheets of paper 2 being extracted or separated from going through the entrance section for entry into the separation part 13 more than necessary. Normally, the part through which the tip end section of the sheets of paper 1, 2 enters the separation part is formed into a smooth curved surface. However, when the above part is formed into a smooth curved surface, it becomes possible for a plurality of sheets of paper 1, 2 to easily enter the gap in an overlapping manner, and hence it is desirable that the entry section of the sheets of paper 2 be formed into a right-angled shape as shown in FIGS. 1 to 5.

Figure 9:
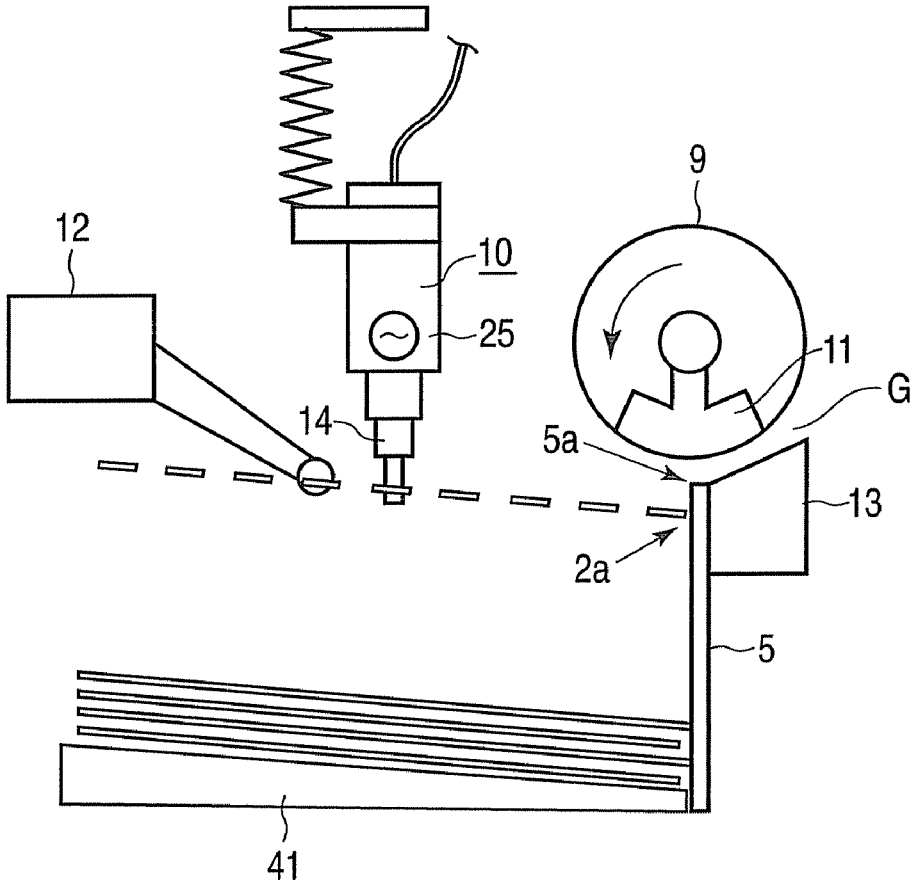
FIG. 9 is a schematic view showing another modification example of the separation/extraction apparatus shown in FIG. 1.
Figure 10:
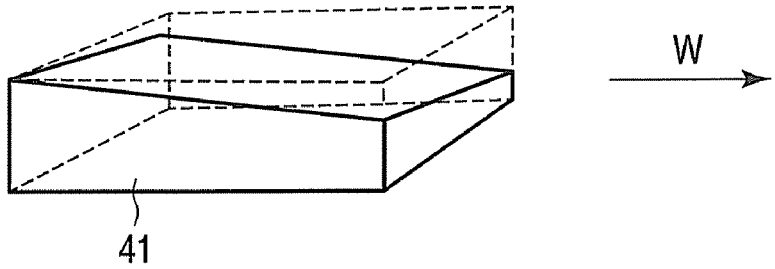
FIG. 10 is a perspective view schematically showing the support base shown in FIG. 9.

FIG. 9 shows a modification example of the separation/extraction apparatus shown in FIG. 1. In the separation/extraction apparatus shown in FIG. 1, the support base 4 includes a carrying surface which is perpendicular to the front side surface guide 5, and on which the pile of sheets of the medium 3 is placed. However, the support base 4 may include a carrying surface forming an acute angle (angle smaller than 90°) with the front side surface guide 5 as shown in FIG. 10. A support base 41 having an inclined carrying surface includes a carrying surface inclined in a direction perpendicular to the sheets of paper extraction direction W. More specifically, the carrying surface is inclined in such a manner that when the pile of sheets of the medium 3 is set on the carrying surface, force for putting the positions of the sheets of paper in order utilizing the gravity acts in the extraction direction (transfer direction) W, and in a direction perpendicular to the direction W, and the sheets of paper 1, 2 are brought into contact with the front side surface guide 5 in a forwardly falling state. By virtue of the inclination of the carrying surface toward the extraction direction W, the pile of sheets of the medium 3 is shifted to the front side surface guide 5 in the extraction direction, with the position thereof being put in order by the guide 5. Further, when the vibrator unit 10 is brought into contact with the pile of sheets of the medium 3, the angle formed by the horn 14 and the sheets of paper 2 of the uppermost surface of the pile of sheets of the medium 3 is not a right angle, and the vibrator unit 10 is obliquely brought into contact with the sheets of paper 2 (as if the vibrating body is inclined in the direction opposite to the extraction direction). Thus, a component of the force resulting from the oblique contact of the vibrator unit 10 is produced in the extraction direction W, thereby making it easier to put the positions of the sheets of paper in order by the front side surface guide 5. Incidentally, as shown in FIG. 9, as described previously with reference to FIG. 2, the height of the uppermost surface sheets of paper 2 is arranged lower than the upper end of the front side surface guide, thereby preventing a large number of sheets of paper 1 from entering the separation part, and preventing defective extraction from occurring.

Normally, in a separation/extraction apparatus or the like for handling a mixture of different types of banknotes, banknotes as the sheets of paper 1, 2 are supplementarily fed into the apparatus from a direction perpendicular to the extraction direction, from the side surface side of the pile of sheets of the medium 3 having the larger height of the inclined support base. That is, the apparatus housing is provided with a door, and when the door is opened, the sheets of paper 1, 2 are fed onto the support base 4 from the direction substantially perpendicular to the extraction direction. The support base 4 is inclined to be lowered in the replenishment direction. Accordingly, when the door is opened to feed the sheets of paper into the apparatus, the higher side of the support base appears, and the sheets of paper 1, 2 are slid into the apparatus from the higher side of the support base 4 toward the lower side, whereby smooth replenishment of the sheets of paper stack is enabled. Further, in an apparatus shown in FIG. 9, by providing the inclination in the direction perpendicular to the extraction direction W, an effect of reducing the possibility of the pile of sheets of the medium 3 being collapsed in the replenishment direction at the time of replenishment can be obtained.

It is apparent that the surface of the support base may be inclined in such a manner that the height of the support base 4 is lowered in the extraction direction W, and in the feed direction of the sheets of paper 1, 2.

Figure 11:
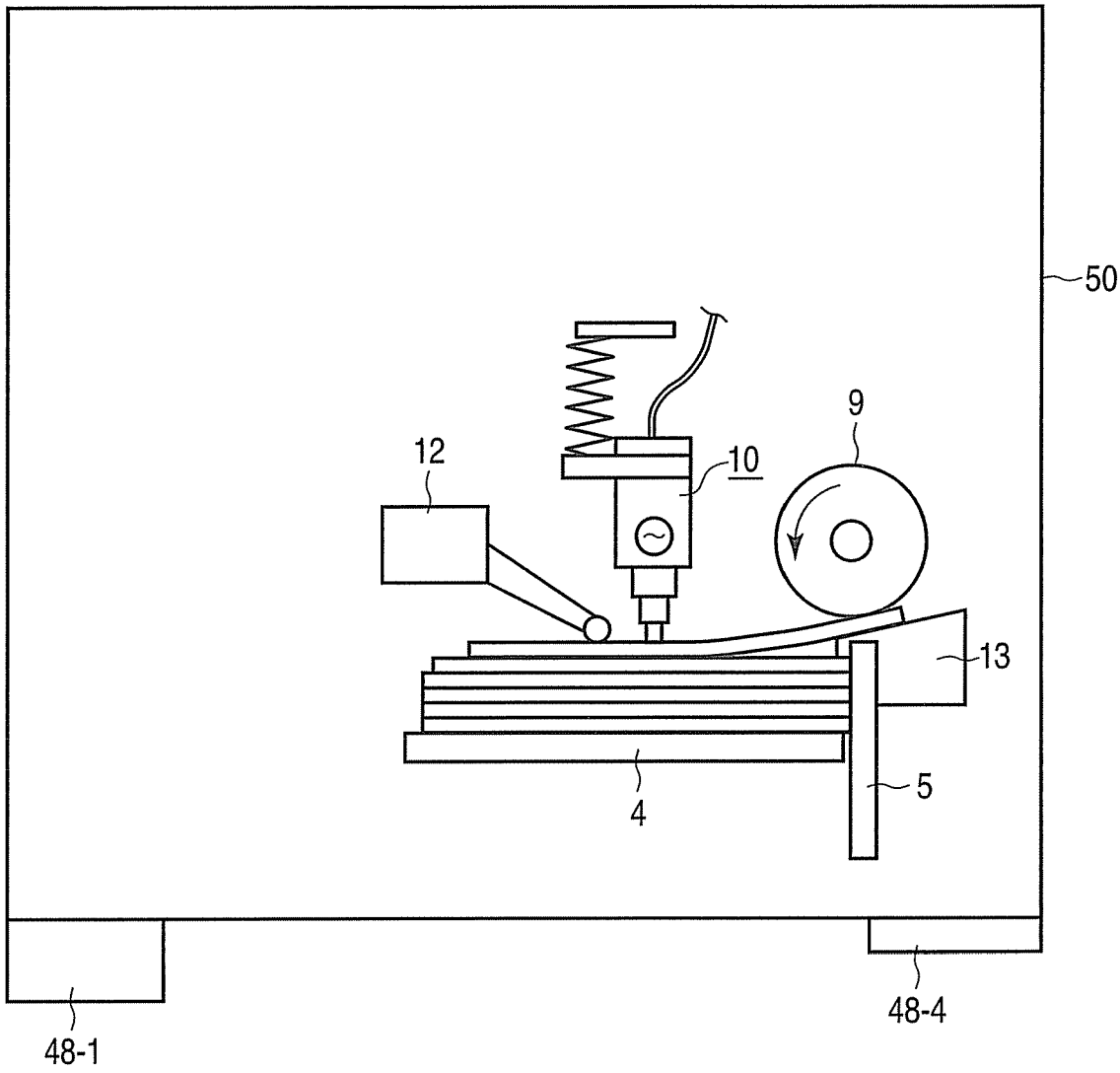
FIG. 11 is a schematic view showing the configuration of a separation/extraction apparatus according to another embodiment of the present invention.

Further, without particularly providing the support base 4 with the inclined carrying surface, the apparatus may be provided with height adjustment mechanisms 48-1 to 48-4 in advance at four corners on the bottom surface of the apparatus housing 50 as shown in FIG. 11, and the entire apparatus may be inclined. By arranging the apparatus housing 50 inclined, it is possible to incline the carrying surface of the support base 4 toward the guide 5 like the support base 41 shown in FIG. 9.

As described above, it is possible to realize a separation/extraction apparatus capable of efficiently providing an effect of reducing friction between stacked sheets of paper of a pile of sheets of the medium, and obtaining a sufficient undoing effect.

As described above, according to the example of the present invention, it is possible to realize a separation/extraction apparatus capable of efficiently providing an effect of reducing friction between stacked sheets of paper of a pile of sheets of the medium, and obtaining a sufficient undoing effect.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A separation and extraction apparatus comprising:

a support base which supports a pile of sheets which are stacked;

a sensor which detects the uppermost surface of the pile of sheets;

a vibrating part having a contact end which is vibrated and is in contact with the uppermost surface on a first virtual plane, which applies ultrasonic vibration to the pile of sheets, the first virtual plane being defined as to be substantially parallel with the pile of sheets;

a pressing mechanism which applies a pressing force to the vibrating part so as to press the vibrating part against the pile of sheets;

an extraction mechanism which extracts a sheet or sheets of the uppermost surface from the pile of sheets in a transfer direction, and transferring the extracted sheet or sheets, the extraction mechanism having an outermost circumference part which is contact with the sheet or sheets on a second virtual plane being defined as to be substantially parallel with the pile of sheets;

a guide having a surface which is brought into contact with the pile of sheets to straighten the sheets, wherein the guide further has a guide end defining a guide entrance between the guide end and the outermost circumference part of the extraction mechanism, the sheets being guided to the guide entrance from the pile of sheets and extracted through the guide entrance, the guide end being substantially arranged between the first virtual plane and the second virtual plane and is extended substantially perpendicular to a transfer path of the sheets passing through the guide entrance;

a separation part which separates the sheets guided in the guide entrance from each other, the separation part forming the transfer path of the sheet; and air blow-off parts which blow air from the both sides of the pile of sheets, the blow air being supplied to the pile of sheets so as to lift up the ends of the sheets above the guide end and guide the ends of the sheets to the outermost circumference part of the extraction mechanism.

2. The separation and extraction apparatus according to claim 1, wherein the air blow-off part blows air out in a direction substantially perpendicular to the extraction direction of the sheet or the sheets.

3. The separation and extraction apparatus according to claim 1, wherein the air includes ionized air.

4. The separation and extraction apparatus according to claim 1, wherein the air includes air containing moisture.

5. The separation and extraction apparatus according to claim 1, further comprising a drive mechanism which drives the support base in accordance with a position signal from the sensor to maintain the uppermost surface of the sheets at substantially a constant position.

6. The separation and extraction apparatus according to claim 1, wherein the support base includes an inclined mount surface on which the pile of sheets is mounted with such inclination that the height of the sheets becomes lower along the transfer direction.

7. The separation and extraction apparatus according to claim 1, wherein the support base includes an inclined mount surface on which the pile of sheets is mounted with such inclination that the height between the uppermost surface of the pile and the guide end becomes lower along a feeding direction in which the sheets are fed to the support base.

* * * * *